US006631595B1

(12) United States Patent
Minter

(10) Patent No.: US 6,631,595 B1
(45) Date of Patent: Oct. 14, 2003

(54) BRICKMOLD

(76) Inventor: Mearl J. Minter, 428 N. 10th St., Oskaloosa, IA (US) 52577

( * ) Notice: Subject to any disclaimer, the term of this patent is extended or adjusted under 35 U.S.C. 154(b) by 0 days.

(21) Appl. No.: 09/910,998

(22) Filed: Jul. 23, 2001

(51) Int. Cl.[7] ..... E06B 1/04

(52) U.S. Cl. ..... 52/212; 52/204.54; 52/213; 52/288.1; 52/717.01; 52/717.05; 52/717.06; 52/718.03; 52/718.04; 49/504; 49/DIG. 2

(58) Field of Search ..... 52/11, 212, 207.1, 52/717.01, 718.03, 718.04, 717.05, 717.06, 204.1, 204.53, 204.54, 204.2, 288.1, 204.55, 204.56, 210, 213, 217; 49/504, 505, DIG. 2

(56) References Cited

U.S. PATENT DOCUMENTS

| | | | | |
|---|---|---|---|---|
| 3,768,220 A | | 10/1973 | Riegelman | |
| 3,984,955 A | | 10/1976 | Yamamoto et al. | |
| 4,920,709 A | | 5/1990 | Garries et al. | |
| 5,018,325 A | | 5/1991 | Geen et al. | |
| 5,058,323 A | * | 10/1991 | Gerritsen | 49/504 |
| 5,090,174 A | * | 2/1992 | Fragale | 52/309.9 |
| 5,115,605 A | | 5/1992 | Butler | |
| 5,392,574 A | | 2/1995 | Sayers | |
| 5,412,909 A | * | 5/1995 | Wu | 49/505 |
| 5,557,894 A | | 9/1996 | Card | |
| 5,651,222 A | * | 7/1997 | Bridges et al. | 52/211 |
| 5,660,010 A | | 8/1997 | Sayers | |
| 5,669,192 A | | 9/1997 | Opdyke et al. | |
| 5,678,367 A | | 10/1997 | Kline | |
| 5,758,458 A | * | 6/1998 | Ridge | 52/204.1 |
| 5,966,880 A | * | 10/1999 | Bridges et al. | 52/211 |
| 6,055,782 A | * | 5/2000 | Morton et al. | 52/204.1 |
| 6,125,605 A | * | 10/2000 | Young | 52/717.01 |

* cited by examiner

*Primary Examiner*—Carl D. Friedman
*Assistant Examiner*—Yvonne M. Horten
(74) *Attorney, Agent, or Firm*—Brett Trout

(57) ABSTRACT

A brickmold assembly for application to a building defining an opening, the brickmold assembly comprising a brickmold comprising an interior face and an exterior face, cladding comprising an inner face provided over and in contact with at least a portion of the exterior face of the brickmold, and a channel integrally molded with the cladding.

21 Claims, 5 Drawing Sheets

86
86
100
102
88
90
92
82
94
80
84

BRICKMOLD

BACKGROUND OF THE INVENTION

1. Field of the Invention

The present invention relates in general to brickmold cladding and, more specifically, to integrally molded cladding provided with a watershed channel to prevent ingress of water between the cladding and the channel.

2. Description of the Prior Art

It is well known in the art to use siding to cover and protect buildings. Typically, siding is constructed of aluminum, vinyl or steel, and is attached directly to the exterior surface of a building. Most buildings contain framed openings for various types of fenestration. Siding is trimmed to leave a slight clearance between brickmold provided around the opening and the siding. The gap between the brickmold and the siding has unappealing aesthetics and allows for the ingress of water. To cover the gap, it is known in the art to secure a J-mold channel to the building, using a nail or similar securing means provided through a rear fin of the J-mold. The rear fin is used to attach the J-mold to the building and a front fin is used to hide the gap between the siding and the brickmold. Both fins work in conjunction with the floor of the J-mold to form a channel to divert water away from the brickmold. This construction reduces the likelihood of water obtaining ingress to the building through the opening left between the siding and the brickmold. Typically, the floor of such J-molds is secured to the brickmold with a bead of caulk.

If applied correctly, caulk provided between the J-mold and the brickmold provides a watertight seal. However, such connections are made in the field under time and material constraints, which often lead to a bead of caulk which is either too thin, or provided with gaps large enough to allow water to pass. The J-mold and brickmold are also often constructed of materials having different coefficients of thermal expansion. Accordingly, as the J-mold and brickmold are heated and cooled, they move relative to one another. Over time, due to inappropriate application of the caulk bead, or the J-Mold and brickmold moving relative to one another, the caulk beads tend to crack and create gaps through which water may pass to the building.

Prior art J-mold assemblies, therefore, have numerous disadvantages, including increased weight, unaesthetic appearance, in field assembly, a tendency to leak when incorrectly secured to a frame member, and a tendency to leak after the caulk begins to deteriorate. It would be desirable to provide an integral J-mold and frame cladding assembly which eliminates the need for a caulk bead and, therefore, not only reduces the cost of production and assembly time, but also eliminates failure due to caulk bead deterioration. The difficulties encountered in the prior art discussed hereinabove are substantially eliminated by the present invention.

SUMMARY OF THE INVENTION

In an advantage provided by this invention, a J-mold is integrally molded with brickmold cladding to reduce the weight and cost of separately molding the items.

Advantageously, this invention provides a J-mold which does not require an in-the-field assembly and caulk bead to secure the J-mold to the frame.

Advantageously, this invention provides a J-mold and brickmold cladding assembly which is not subject to water ingress as the result of caulk bead deterioration.

Advantageously, this invention provides a J-mold and brickmold cladding assembly which reduces installation time.

Advantageously, in a preferred example of this invention, a brickmold assembly for application to a building defining an opening is provided, comprising a brickmold comprising an interior face and an exterior face, cladding comprising an interface provided over, and in contact with, at least a portion of the exterior face of the brickmold, and means integrally molded with the cladding for directing rain away from the cladding.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
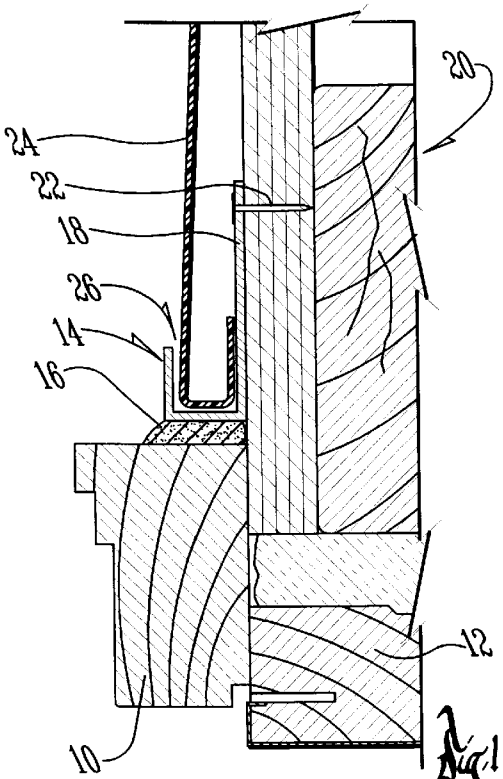
Fig. 1 (PRIOR ART)
FIG. 1 illustrates a prior art J-mold secured to a prior art frame member with a bead of caulk.

Referring to FIG. 1, it is known in the art to provide a brickmold (10) around a window frame (12) and to secure a J-mold (14) to the brickmold (10) with a caulk bead (16). As shown in FIG. 1, the prior art J-mold (14) is provided with a rear fin (18) which is separately secured to the building (20) by a nail (22). A piece of siding (24) is positioned within a channel (26) created by the J-mold (14). This construction allows rain water (not shown) moving downward along the siding (24) to be directed along the channel (26) away from the brickmold (10), and away from the building (20).

When properly constructed, this assembly prevents rainwater from obtaining ingress to the building (20) between the J-mold (14) and brickmold (10). However, even when assembled correctly, the prior art J-mold (14) requires additional assembly time out in the field to apply the caulk bead. The assembly is subject to leakage if the caulk bead (16) is not applied properly, if the caulk bead (16) begins to deteriorate, or if the differences in thermal expansion between the components opens gaps in the caulk bead (16).

Figure 2:
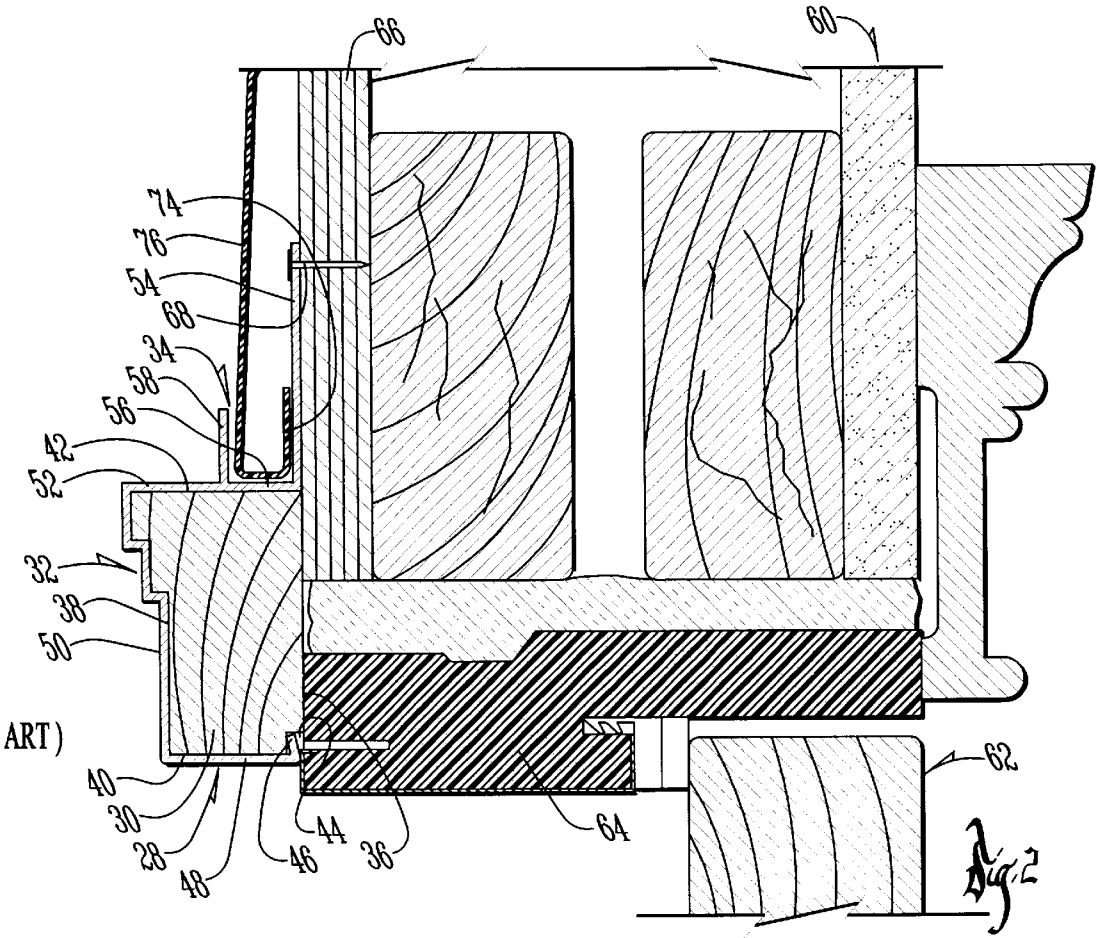
FIG. 2 illustrates an example cross-section of an improved brickmold assembly according to this invention, applied to a framed opening of a building.

FIG. 2 illustrates the brickmold assembly (28) of the present invention. The brickmold assembly (28) comprises a brickmold (30), cladding (32) and a channel (34). The brickmold (30) is of a type known in the prior art, including an interior face (36), an exterior face (38), an inward face (40) and an outward face (42). The brickmold (30) is preferably constructed of wood, but may be constructed of fiberglass pultrusion material or any suitable material. As shown in FIG. 2, the brickmold (30) is provided with a recess (44) in its inward face (40). The cladding (32) includes a flange (46) provided within the recess (44), a bottom (48) provided over the inward face (40) of the brickmold (30), an outer face (50) provided over the exterior face (38) of the brickmold (30), and a top (52) provided over the outward face (42) of the brickmold (30).

Figure 3:
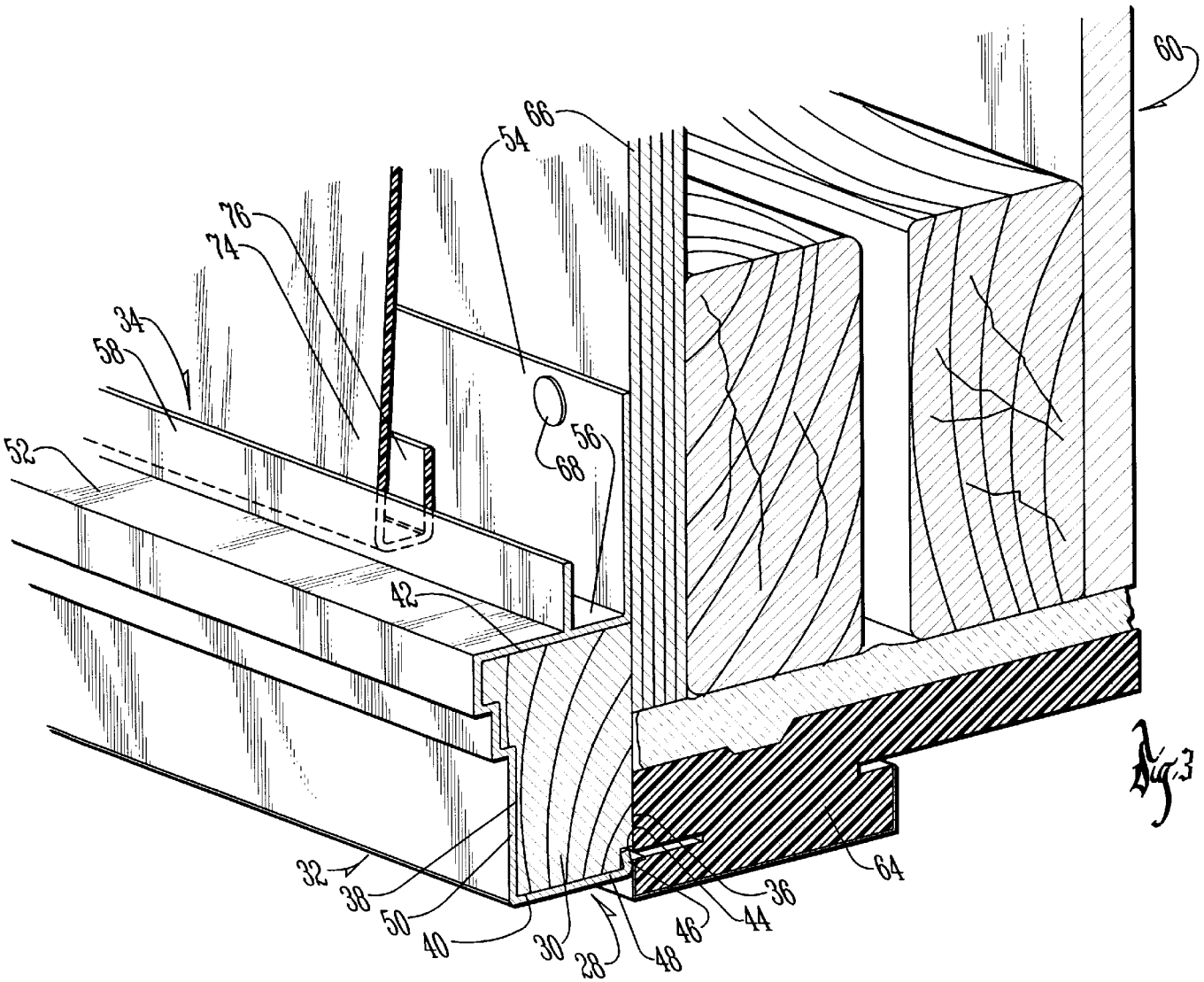
FIG. 3 illustrates a perspective cross-section of the brickmold assembly, window frame and headers of FIG. 2.

The channel (34) is integrally molded to the cladding (32) and includes an inner wall (54) coupled to a floor (56) which, in turn, is coupled to a longer outer wall (58). (FIG. 3). The floor (56) is provided over, and in contact with, a portion of the outward face (42) of the brickmold (30). Although the channel (34) can be secured to the cladding (32) by any suitable means, in the preferred embodiment of the present invention, the channel (34) and cladding (32) are integrally extruded from a single piece of aluminum or fiberglass pultrusion material. Of course, it should be noted that the cladding (32) and channel (34) may be constructed of weather-resistant material such as thermoplastic material, or of any suitable material known in the art.

Figure 4:
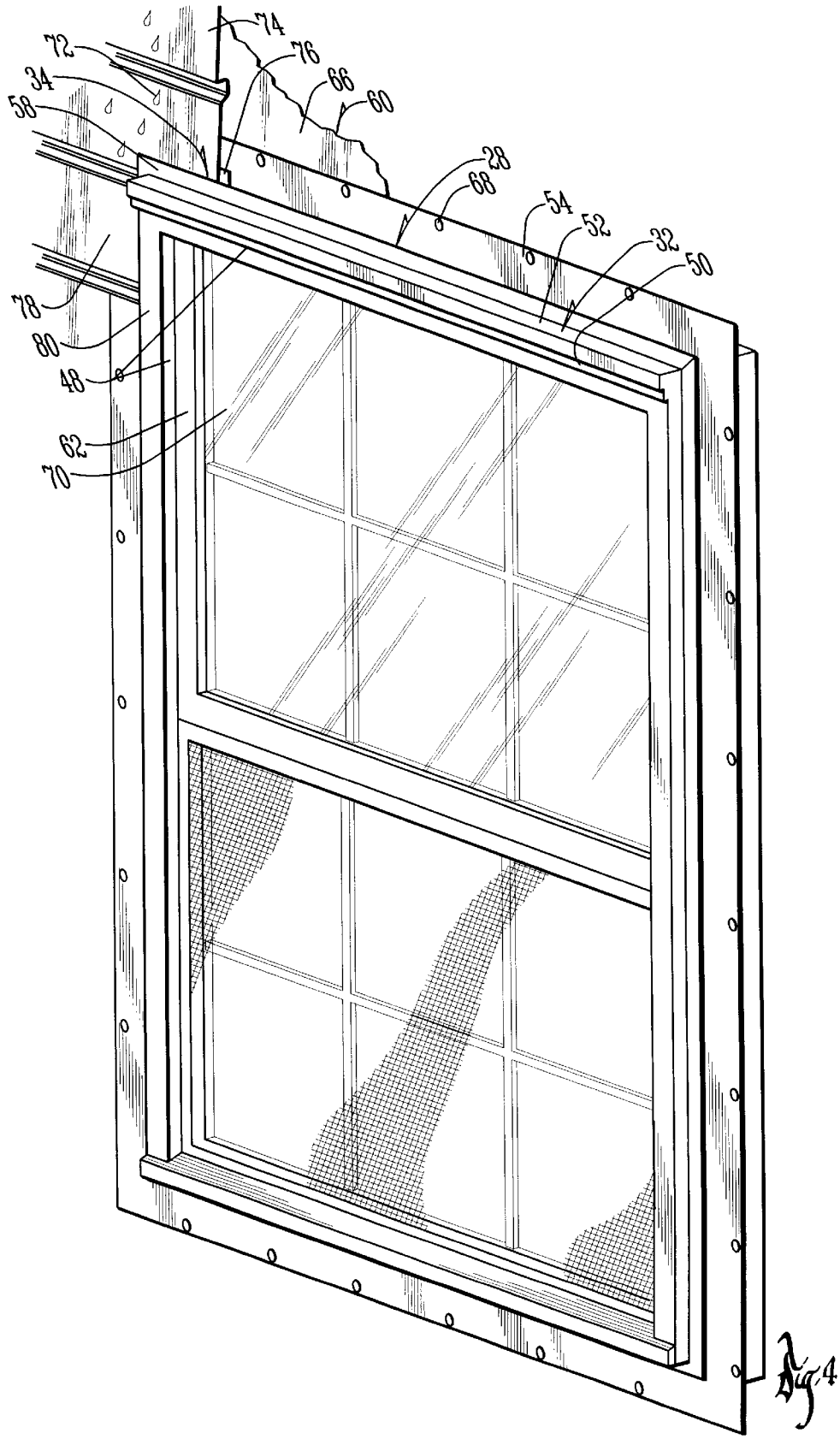
FIG. 4 illustrates a perspective view of the brickmold assembly of the present invention, secured to a window frame and provided with siding in the channel of the J-mold.

A building (60) is provided with a framed member (62) in the form of a double-hung window. (FIG. 4). As shown in FIGS. 2 and 3, the brickmold (30) is secured by nails (not shown) or similar securement means to the framed member (62). The cladding (32) is provided over the brickmold (30) with the flange (46) provided in the recess (44) of the brickmold (30) to maintain the cladding (32) in place. Provided around the framed member (62) is insulation (64), such as that well known in the art. Once the cladding (32) is positioned over the brickmold (30), the inner wall (54) of the channel (34) is secured to an exterior portion (66) of the building (60) with a plurality of nails (68).

As shown in FIG. 4, the channel (34) extends across the top and down the side of a window (70). As shown in FIGS. 3–4, a first piece of siding (74) is provided with a lower portion (76) within the channel (34). Preferably, the lower portion (76) of the siding (74) does not rest on the channel (34). Instead, it has been shown to be advantageous to raise the siding (74) slightly to allow the siding (74) to expand and contract without buckling. Similarly, a second piece of siding (78) is provided with a right edge (80) within the channel (34). Again, the right edge (80) of the siding (78) is not contiguous with the floor (56) of the channel (34) to allow the siding (78) to expand and contract without buckling. When assembled, the outer wall (58) of the channel (34) hides the gap between the right edge (80) of the second piece of siding (78), and the window (70), and the channel (34) directs rain water (72) moving across the first piece of siding (74) to the sides of the window (70) and away from the cladding (32). Integrally molding the channel with the cladding (32) prevents rainwater (72) from entering any interstices formed between J-molds (14) and a brickmolds (10) of the prior art, due to an inadequate or degradizing caulk bead (16). (FIGS. 1 and 4).

Figure 5:
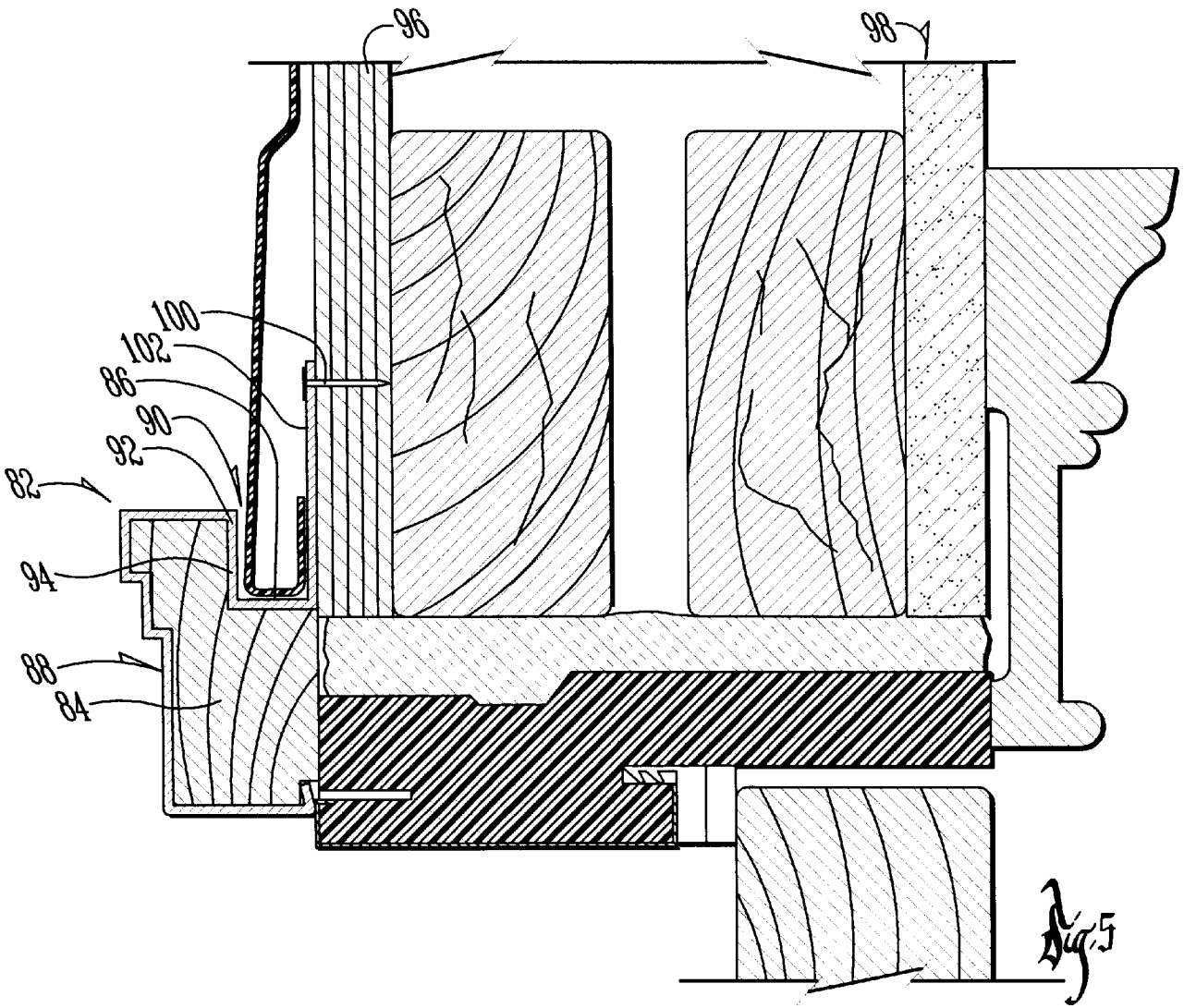
FIG. 5 illustrates an alternative embodiment of the brickmold assembly, shown with the J-mold recessed into the brickmold.

FIG. 5 shows an alternative embodiment of the brickmold assembly (82) in which a brickmold (84) is provided with a recess (86). Cladding (88) provided around the brickmold (84) is integrally molded with a channel (90) in a contour similar to that of the brickmold (84). The channel (90), therefore, is positioned within the recess (86). The cladding (88) is integrally molded to an upper portion (92) of an outer wall (94) of the channel (90) instead of to a lower portion of the outer wall (94), as described above in the preferred embodiment. As with the preferred embodiment of the present invention, the alternative brickmold assembly (82) is secured to an exterior portion (96) of the building (98) by a nail (100), passing through an inner wall (102) of the channel (90).

Figure 6:
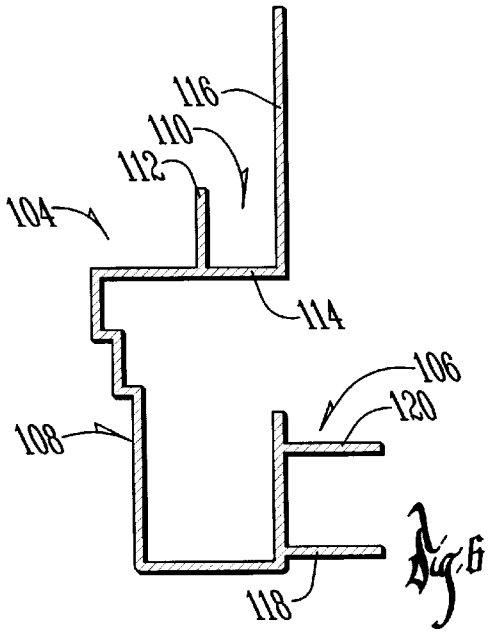
FIG. 6 illustrates an example cross-section of an alternative embodiment of the improved brickmold assembly according to this invention.

FIG. 6 illustrates an alternative embodiment of the present invention. Shown generally as (104) in FIG. 6, is the alternative brickmold assembly. The alternative brickmold assembly (104) comprises a retaining assembly (106), cladding (108), and a channel (110). As with the brickmold assembly (28) of the preferred embodiment, the alternative brickmold assembly (104) may be constructed of wood, fiberglass pultrusion material, or of any suitable material known in the art. As with the preferred embodiment of the present invention, the channel (110) is integrally molded to the cladding (108), and includes an inner wall (112) coupled to a floor (114) which, in turn, is coupled to a longer, outer wall (116). Unlike the brickmold assembly (28) of the present invention, however, the alternative brickmold assembly (104) does not include brickmold. Instead, the alternative brickmold assembly (104) is provided with the retaining assembly (106), comprising a first retaining flange (118) and a second retaining flange (120).

Figure 7:
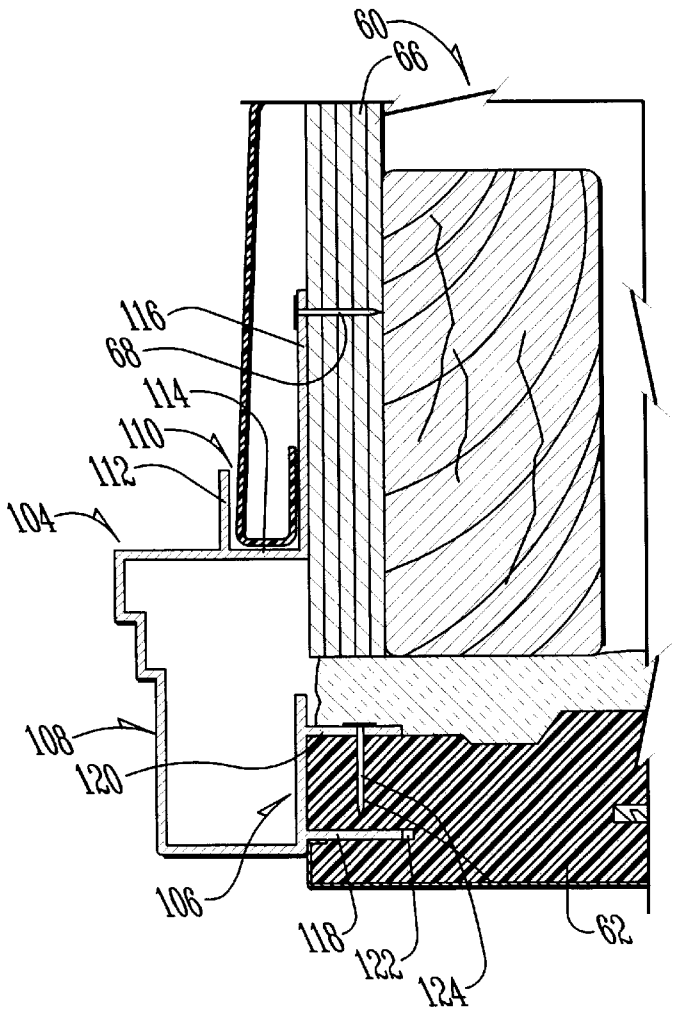
FIG. 7 illustrates an example cross-section of the alternative embodiment of the present invention of FIG. 6, shown applied to a framed opening of a building.

As shown in FIG. 7, the framed member (62) is provided with a kerf (122) sized to accommodate the first retaining flange (118). Accordingly, when the alternative brickmold assembly (104) is applied to the framed member (62), the first retaining flange (118) fits into the kerf (122), while the second retaining flange (120) fits over a portion of the framed member (62), as shown. Once the alternative brickmold assembly (104) has been positioned in this manner, a plurality of nails (124) are driven through the second retaining flange (120), the framed member (62) and the first retaining flange (118) to maintain the brickmold assembly (104) in place. Thereafter, the longer, outer wall (116) of the channel (110) is nailed into the exterior portion (66) of the building (60) with a plurality of nails (68) in a manner such as that described above. The alternative brickmold assembly (104) allows for the complete elimination of the brickmold portion of the assembly, while decreasing weight and construction costs.

Although the invention has been described with respect to a preferred embodiment thereof, it is to be also understood that it is not to be so limited, since changes and modifications can be made therein, which are within the full intended scope of this invention as defined by the appended claims. For example, it should be noted that the brickmold (30), cladding (32) and channel (34) may be constructed of any desirable configurations, or of any suitable material. Additionally, the channel (34) may be secured to the cladding (32) by weldments or any other suitable securing means known in the art.

What is claimed is:

1. A brickmold assembly for reducing water damage to a building comprising:

a. a brickmold comprising:
   i. an interior face;
   ii. an exterior face;
   iii. an inward face;
   iv. an outward face;

b. cladding comprising:
   i. an inner face provided over, and in contact with at least a portion of said exterior face of said brickmold;
   ii. an outer, weather-resistant face;
   iii. a top provided over, and in contact with, at least a portion of said outward face of said brickmold;
   iv. a bottom provided over, and in contact with, at least a portion of said inward face of said brickmold;

c. a channel comprising:
i. an outer wall;
ii. a floor;
iii. an inner wall;
iv. wherein said floor is integrally molded to said outer wall and said inner wall;
v. wherein said floor is in contact with said brickmold;

d. wherein said channel is integrally molded with said cladding; and e. wherein said inward face of said brickmold is provided with a recess, and further comprising a flange secured to said bottom of said cladding, and secured within said recess.

2. The brickmold assembly of claim 1, wherein said channel comprises:

a. an outer wall;

b. a floor, c. an inner wall;

d. wherein said floor is integrally molded to said outer wall and said inner wall; and e. wherein said floor is in contact with said brickmold.

3. The brickmold assembly of claim 2, wherein said inner wall is longer than said outer wall.

4. The brickmold assembly of claim 2, wherein said channel is watertight and constructed with a generally J-shaped cross-section.

5. The brickmold assembly of claim 2, wherein said cladding, said outer wall, said floor and said inner wall are all integrally extruded from aluminum.

6. The brickmold assembly of claim 2, wherein said cladding, said outer wall, said floor and said inner wall are all integrally extruded from thermoplastic material.

7. The brickmold assembly of claim 2, wherein said cladding, said outer wall, said floor and said inner wall are all integrally extruded from a fiberglass pultrusion material.

8. The brickmold assembly of claim 2, further comprising means for securing said inner wall to the building.

9. The brickmold assembly of claim 8, wherein said securing means is a nail secured to the building through said inner wall.

10. The brickmold assembly of claim 2, further comprising a piece of siding having an end, wherein said end of said siding is positioned within said channel.

11. A brickmold assembly for reducing water damage to a building comprising:

a. a brickmold comprising:
i. an interior face;
ii. an exterior face;
iii. an inward face;
iv. an outward face;

b. cladding comprising:
i. an inner face provided over, and in contact with at least a portion of said exterior face of said brickmold;
ii. an outer, weather-resistant face;
iii. a top provided over, and in contact with, at least a portion of said outward face of said brickmold;
iv. a bottom provided over, and in contact with, at least a portion of said inward face of said brickmold;

c. a channel comprising:
i. an outer wall;
ii. a floor,
iii. an inner wall;
iv. wherein said floor is integrally molded to said outer wall and said inner wall;
v. wherein said floor is in contact with said brickmold;

d. wherein said channel is integrally molded with said cladding;

e. wherein said brickmold is provided with a recess, and wherein at least a portion of said cladding extends into said recess; and f. a piece of siding having an end, wherein said end of said siding is positioned within said channel.

12. The brickmold assembly of claim 11, wherein said channel is watertight and constructed with a generally J-shaped cross-section.

13. The brickmold assembly of claim 11, wherein said cladding, said outer wall, said floor and said inner wall are all integrally extruded from aluminum.

14. The brickmold assembly of claim 11, wherein said cladding, said outer wall, said floor and said inner wall are all integrally extruded from thermoplastic material.

15. The brickmold assembly of claim 11, wherein said cladding, said outer wall, said floor and said inner wall are all integrally constructed of a fiberglass pultrusion material.

16. The brickmold assembly of claim 11, further comprising means for securing said inner wall to the building.

17. The brickmold assembly of claim 16, wherein said securing means is a nail secured to the building through said inner wall.

18. A brickmold assembly for reducing water damage to a building comprising:

a. a brickmold comprising:
i. an interior face;
ii. an exterior face;
iii. an inward face;
iv. an outward face;

b. cladding comprising:
i. an inner face provided over, and in contact with at least a portion of said exterior face of said brickmold;
ii. an outer weather resistant face;
iii. a top provided over, and in contact with at least a portion of said outward face of said brickmold;
iv. a bottom provided over, and in contact with at least a portion of said inward face of said brickmold;

c. a substantially watertight channel comprising:
i. an outer wall;
ii. a floor,
iii. an inner wall longer than said outer wall;
iv. wherein said floor is integrally molded to said outer wall and said inner wall,
v. wherein said floor is in contact with said brickmold;
vi. wherein said channel is integrally molded with said cladding;

d. means for securing said inner wall to the building; and e. a piece of siding having an end, wherein said end of said piece of siding is positioned within said watertight channel.

19. The brickmold assembly of claim 18, wherein said cladding and said channel are integrally extruded from aluminum.

20. The brickmold assembly of claim 18, wherein said cladding and said channel are constructed of a fiberglass pultrusion material.

21. A brickmold assembly for reducing water damage to a building comprising:

a. a brickmold comprising:
i. an interior face;
ii. an exterior face;
iii. an inward face;

iv. an outward face;

b. cladding comprising:

i. an inner face provided over, and in contact with at least a portion of said exterior face of said brickmold;

ii. an outer, weather-resistant face;

iii. a top provided over, and in contact with, at least a portion of said outward face of said brickmold;

iv. a bottom provided over, and in contact with, at least a portion of said inward face of said brickmold;

c. a channel comprising:

i. an outer wall;

ii. a floor;

iii. an inner wall, wherein said inner wall is longer than said outer wall;

iv. wherein said floor is integrally molded to said outer wall and said inner wall;

v. wherein said floor is in contact with said brickmold;

d. wherein said channel is integrally molded with said cladding; and e. wherein said brickmold is provided with a recess, and wherein at least a portion of said cladding extends into said recess.

* * * * *

UNITED STATES PATENT AND TRADEMARK OFFICE

CERTIFICATE OF CORRECTION

PATENT NO. : 6,631,595 B1
DATED : October 14, 2003
INVENTOR(S) : Mearl J. Minter It is certified that error appears in the above-identified patent and that said Letters Patent is hereby corrected as shown below:

Title page,
Item [73], please add: -- [73], Assignee: Pella Corporation
Pella, IA (US) --

Signed and Sealed this

Twentieth Day of July, 2004

JON W. DUDAS
*Acting Director of the United States Patent and Trademark Office*